United States Patent [19]

Heap

[11] 4,408,542

[45] Oct. 11, 1983

[54] CENTER SILL GONDOLA CAR

[75] Inventor: James C. Heap, Munster, Ind.

[73] Assignee: Thrall Car Manufacturing Company, Chicago Heights, Ill.

[21] Appl. No.: 818,671

[22] Filed: Jul. 25, 1977

[51] Int. Cl.[3] ..... B61D 3/00; B61D 7/00; B61D 17/00

[52] U.S. Cl. ..... 105/406 R; 105/239; 105/244; 105/409

[58] Field of Search ..... 105/248, 282 R, 359, 105/360, 406 R, 416, 418, 419, 422, 250, 251, 411, 244, 239, 409

[56] References Cited

U.S. PATENT DOCUMENTS

| | | | |
|---|---|---|---|
| 45,834 | 1/1865 | Keeler | 105/359 |
| 750,049 | 1/1904 | Carnahan | 105/406 R |
| 785,174 | 3/1905 | King | 105/406 R |
| 861,208 | 7/1907 | Dodds | 105/250 |
| 884,325 | 4/1908 | Dodds | 105/251 |
| 921,112 | 5/1909 | Howard | 105/251 |
| 1,314,045 | 8/1919 | Campbell | 105/250 |
| 1,531,761 | 3/1925 | Seiders | 105/406 R |
| 1,828,842 | 10/1931 | Louiks | 105/422 X |
| 3,127,851 | 4/1964 | Auksel | 105/248 |
| 3,175,520 | 3/1965 | Talmey | 105/419 X |
| 3,240,168 | 3/1966 | Charles et al. | 105/406 R |
| 3,420,192 | 1/1969 | Ellis | 105/422 |
| 3,713,400 | 1/1973 | Teoli | 105/422 X |
| 3,776,144 | 12/1973 | Eislers | 105/406 R |
| 3,817,189 | 6/1974 | Bailey et al. | 105/360 |
| 3,841,236 | 10/1974 | Hammonds et al. | 105/406 R |
| 3,918,370 | 11/1975 | Campbell et al. | 105/416 |

OTHER PUBLICATIONS

Carbuilder, Pulman Standard, Jan. 1977, Issue No. 1, front cover, XXXIX, 8, 9 and rear mailing cover pages.

Progressive Railroading, Aug. 1977, Murphy-Richter Publishing Co., It's Called The "Coalporter", front cover, Contents(5), 67 pages.

*Primary Examiner*—Robert B. Reeves
*Assistant Examiner*—Howard Beltran
*Attorney, Agent, or Firm*—Merriam, Marshall & Bicknell

[57] ABSTRACT

A gondola railway car comprising a car truck attached to each end of a continuous center sill, a pair of generally vertical end panels, a pair of generally vertical side panels joined to the end panels, a plurality of cross bearers extending from the center sill to a longitudinal chord at the bottom of each side panel, a car bottom between the end and side panels having substantially flat portions over the trucks and a longitudinal trough portion between the trucks and the flat bottom portions, the trough portion having side edges joined to the side panel bottom edges and extending beneath the center sill, and an end wall at each end of the trough extending to the adjacent flat bottom portion.

9 Claims, 8 Drawing Figures

14
61
62
5
60
91
66
64
63
4
35
32
65
71
70
33
55
54
20
80
31
30
34
53
52
56
51
13
50
90
81
72

CENTER SILL GONDOLA CAR

This invention relates to railway cars and more particularly to a railway car of the open gondola type in which lading is loaded and unloaded from the open top.

Gondola railway cars are normally employed to carry bulky granular or lump materials such as coal, sand and gravel. Conventional gondola cars have a continuous center sill structure extending the length of the car and a flat floor on the top of the center sill supported by it and cross bearers. This leads to a high center of gravity in the loaded car.

Another Teoli in U.S. Pat. No. 3,713,400 discloses a gondola railway car which has a parabolic shaped bottom between the trucks and no continuous center sill. The center sill is replaced by stub center sills at each end and means for interconnecting the stub center sills with side sills for transferring longitudinal forces the length of the car. The car has no center sill from one stub sill to the other stub sill. The car is said to be light weight because of the use of an unreinforced parabolic bottom sheet and the elimination of the center sill and to have a low center of gravity when loaded.

A. F. Charles U.S. Pat. No. 3,240,168 discloses a gondola railway car much like that shown in the Teoli patent but with the dropped bottom between the trucks reinforced by spaced apart lateral ribs. The Charles car also lacks a center sill between the trucks.

Although the described prior art gondola cars have the advantage of a lower loaded center of gravity and lighter weight empty than a conventional gondola car they are relatively expensive to fabricate since special structures for transfer of longitudinal forces from the end stub sills to the side sills are required.

According to the present invention there is provided a gondola car of reduced weight, increased capacity and lower center of gravity when loaded than conventional gondola cars but which has a continuous center sill from end-to-end. More specifically, there is provided a gondola railway car having a car truck attached to each end of a continuous center sill, a pair of generally vertical end panels, a pair of generally vertical side panels joined to the end panels, a plurality of cross bearers extending between the longitudinal chords at the bottom of each side panel, a car bottom between the end and side panels having substantially flat portions over the trucks and a longitudinal trough portion between the trucks and the flat bottom portions, the trough portion having side edges joined to the side panel bottom edges and extending beneath the center sill, and an end wall at each end of the trough extending to the adjacent flat bottom portion.

The trough is generally spaced downwardly from the bottom of the center sill to provide clearance for lump or granular material to flow therebeneath. For a smooth joint the side edge portions of the trough join the side panels in substantially the same plane. The top of the cross bearers is desirably made about level with, or slightly higher than, the top of the center sill. Desirably, at least one vertical web or plate is joined to a cross bearer and extends and is joined to the trough bottom and divides the trough into compartments to reinforce the trough. With the use of such a web, each compartment can be left unsupported between its ends by the center sill or intermediate cross bearers. Thus, each compartment need contain no internal bracing below the level of the cross bearers.

The trough is generally a smooth arc in lateral section. It may be semi-elliptical, parabolic, a circular cylindrical section, cantenary or of similar shape. It may also be a polygon section with equal or unequal sides may by pressing a flat plate in a press brake to form one or more creases to shape the polygon sides.

The invention will be described further in conjunction with the attached drawings, in which.

So far as is practical the same elements or parts which appear in the different views of the drawings will be identified by the same numbers.

Figure 1:
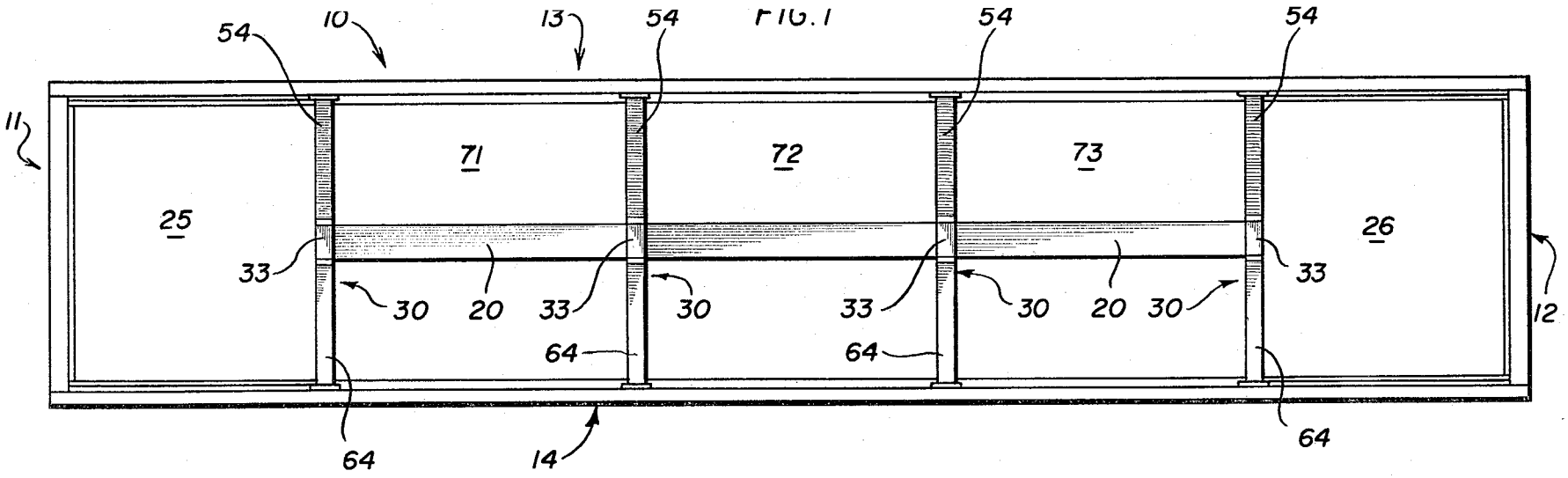
FIG. 1 is a plan view of a gondola railway car provided by the invention.
Figure 2:
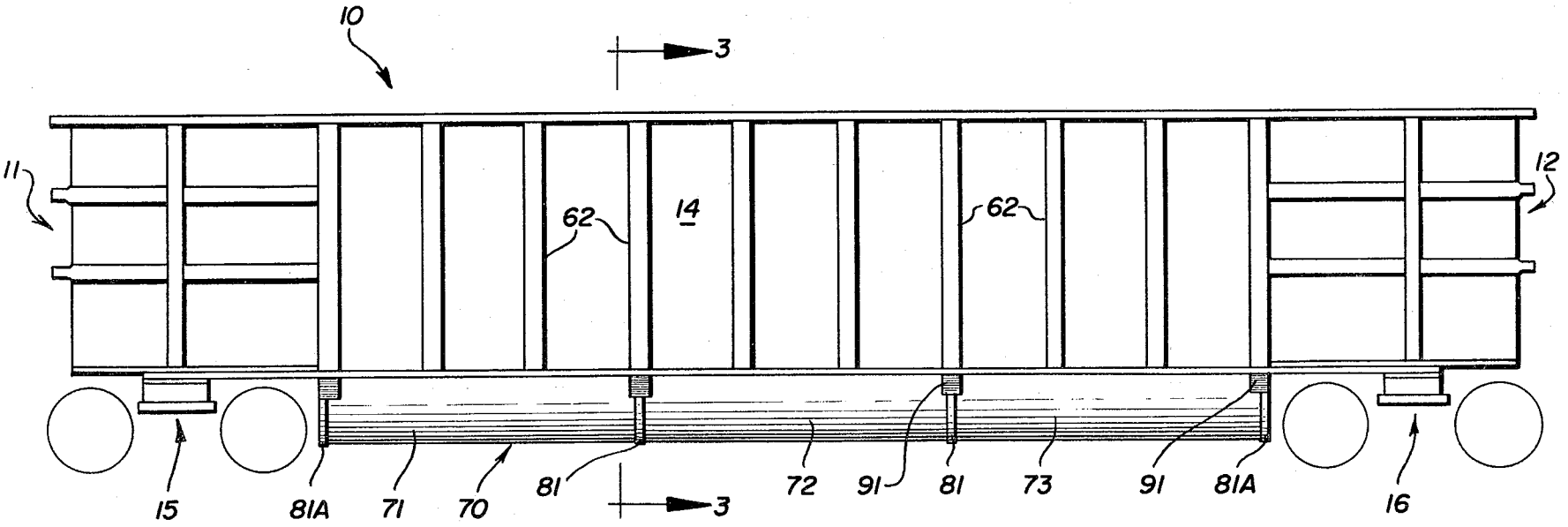
FIG. 2 is a side elevational view of the railway car shown in FIG. 1.

The gondola railway car 10 shown in FIGS. 1 and 2 has a pair of generally vertical end panels 11 and 12 and a pair of generally vertical side panels 13 and 14 joined to the end panels. Car trucks 15 and 16 at each end of the car are attached near the ends of the continuous center sill 20. The car bottom end portions 25 and 26 located over the car trucks 15 and 16 are essentially horizontal and flat and are joined to the bottom edge portions of the side and end panels.

The particular railway car shown in the drawings (FIGS. 1 to 5) has four lateral horizontal spaced-apart cross bearers 30. Each cross bearer is made in two identical parts extending in opposite directions laterally from the center sill 20. Thus angle 31 extends out from one side of the center sill 20 and angle 32 extends out from the other side of the center sill. The outer end of the angles 31 and 32 are joined by welding to the inverted longitudinal channel members 50 and 60 constituting the bottom edges of side panels 13 and 14 respectively. Flat horizontal plate 33 extends laterally over the top of center sill 20 and the top of the inner end portions of angles 31 and 32. Cover plate 34 is placed on top of angle 31 and extends from one end of plate 33 over the top of channel member 50. Similarly, plate 35 is a cover for angle 32 and extends from the other end of plate 33 over the top of channel member 60. The sloped lower surfaces of angles 31 and 32 facilitate flow of coal and other granular materials from the car.

At the top of side panel 13 there is positioned an inverted channel member 51 which constitutes an upper chord of a side sill. Similarly, the inverted channel member 50 constitutes a lower chord of a side sill. Side posts 52 extend between the lower chord 50 and the upper chord 51. Vertical side wall 53 is joined at its top edge to upper chord 51 and at its lower edge to lower chord 50. The side wall 53 slopes outwardly as it extends upwardly to facilitate rotary discharge of lump and granular material from the car. A diagonal brace 54, having a foot plate 55 at its lower end which rests on plate 33 and a wall reinforcing plate 56 at its upper end, is positioned over each cross bearer angle 31. The other side of the railway car is similarly fabricated. Thus, the side panel 14 has an upper chord 61 made of an inverted channel member. Side posts 62 extend between the lower chord 60 and the upper chord 61 which together constitute a side sill. Outwardly sloped side wall 63 is joined at its upper edge to upper chord 61 and at its lower edge to lower chord 60. A diagonal brace 64 is located over each cross bearer angle 32. Foot plate 65 at the lower end of each diagonal brace 64 is positioned on top of plate 33, and a wall reinforcing plate 66 is positioned at the upper end of each diagonal brace 64 at the top portion of side wall 63.

Figures 3, 4, 5:
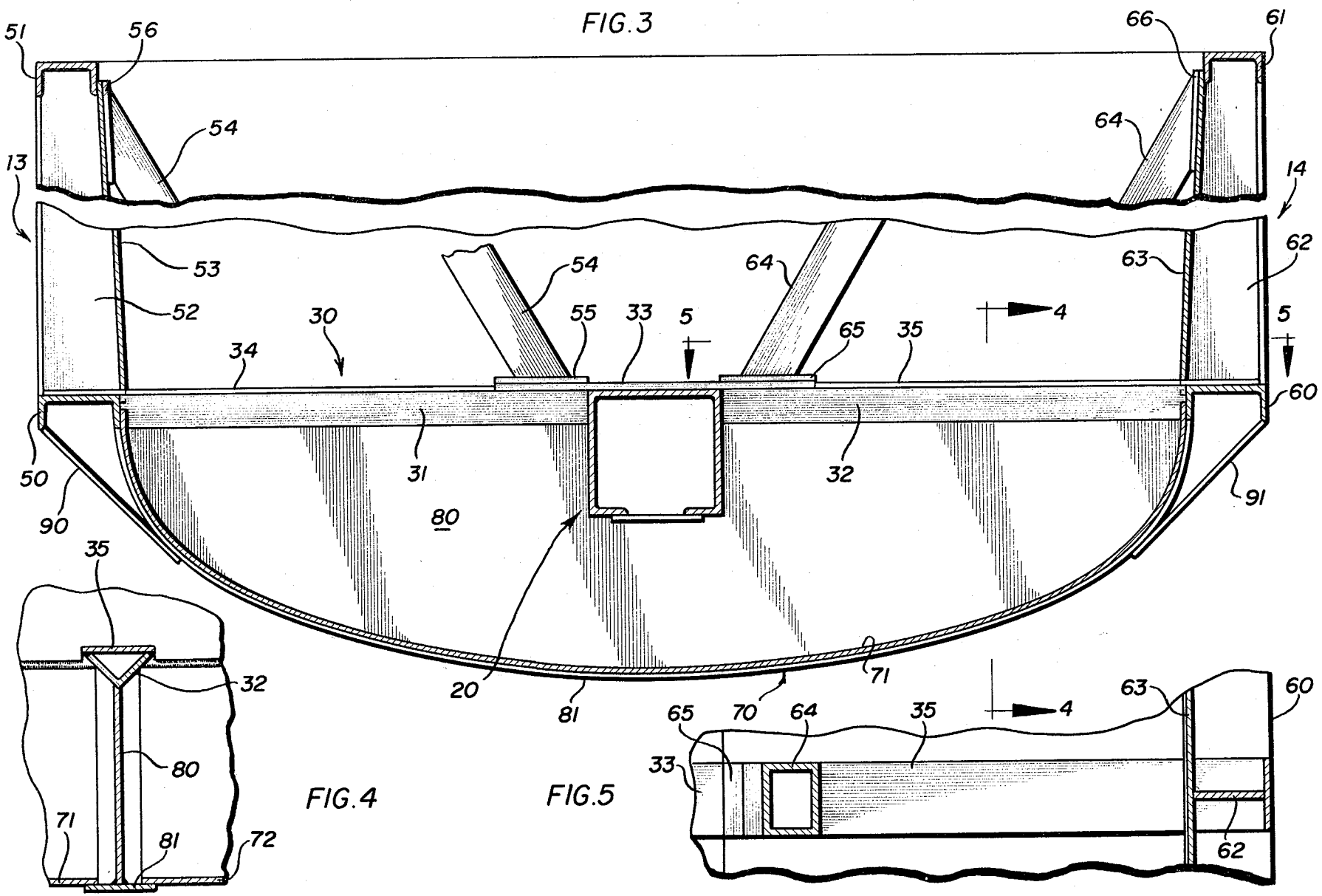
FIG. 3 is a sectional view taken along the line 3—3 of FIG. 2.
FIG. 4 is a sectional view taken along the line 4—4 of FIG. 3.
FIG. 5 is a sectional view taken along the line 5—5 of FIG. 3.

Located between the car trucks 15 and 16 is a longitudinal trough 70 which extends from the car flat bottom portions 25 and 26. The trough 70 in cross section is semi-elliptical and for convenience in fabrication is made of three separate sections 71, 72, and 73. The upper longitudinal side edges of each of the trough sections is welded to the inward vertical side of the lower chords 50 and 60. A vertical plate 80 extends downwardly from the lower edge of the angle members 31 and 32 of each cross bearer 30. (FIGS. 3 and 4). The lower edge of each of the vertical plates 80 is semi-elliptical in shape and coincides with the semi-elliptical shape of each of the trough sections 71, 72 and 73. A metal strip 81 is welded to the lower edge of each vertical plate 80 located inward from the ends of trough 70. Each strip 81 has its ends welded to the lower chords 50 and 60 and extends outwardly from both sides of plate 80. These strips 81 provide support for the adjoining ends of the trough members 71–72, and 72–73 as illustrated by FIG. 4. Strips 81A on vertical trough end plates 80 at the ends of the trough 70 extend only inwardly rather than to both sides of plate 80 as shown in FIG. 4. Only an inward extension is required to receive the outer ends of trough sections 71 and 73. A series of braces 90 extend from the lower edge of lower chord 50 to the strips 81 and 81A to help support trough 70. Similarly, braces 91 extend from the lower edge of lower chord 60 to strips 81 and 81A to reinforce the trough. The described structure divides the trough 70 into three lading compartments. The entire trough 70 is spaced substantially below the bottom of the continuous center sill 20 to provide adequate clearance for lump or granular material to flow unobstructed beneath the sill.

Figure 6:
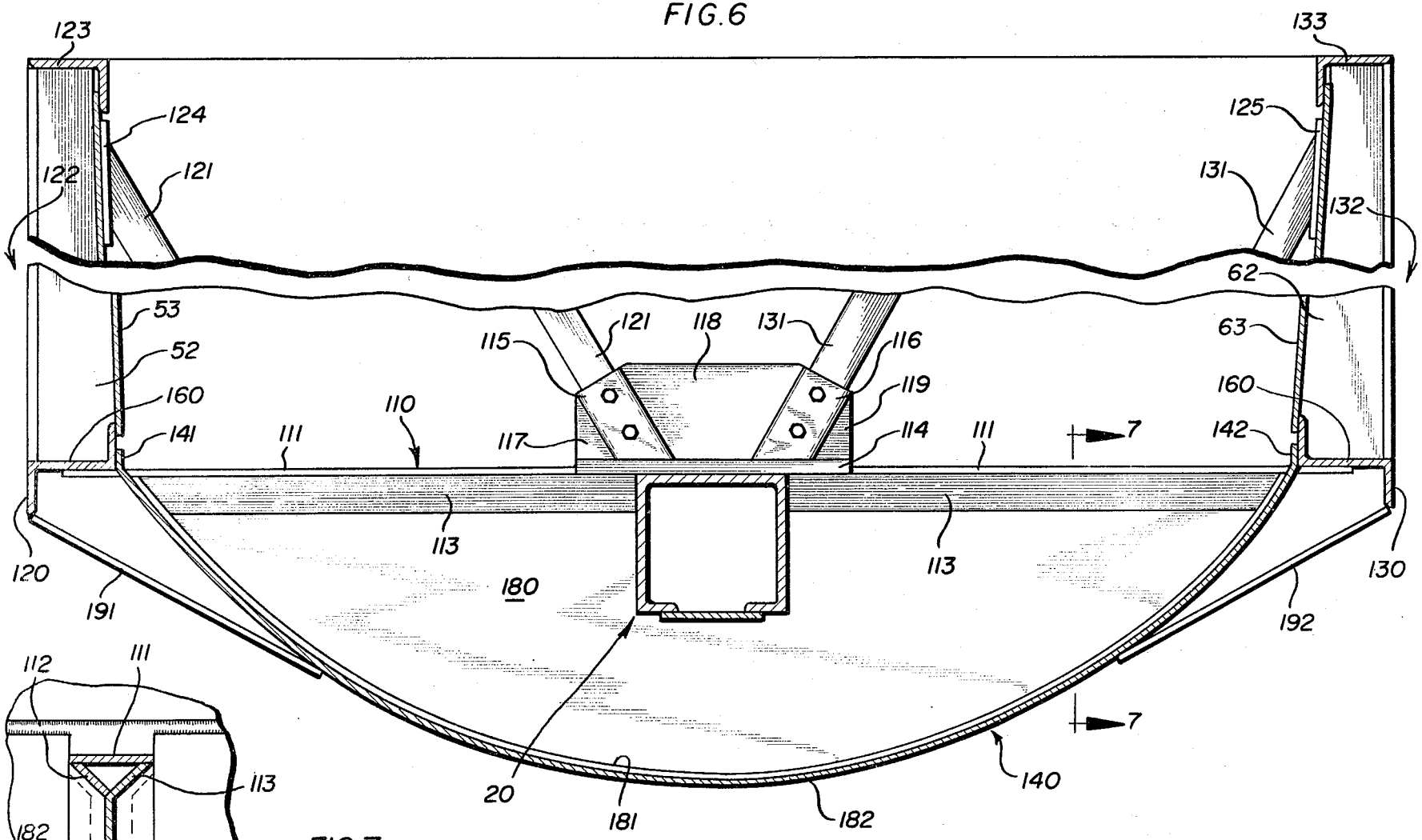
FIG. 6 is a sectional view, like FIG. 3, of another embodiment of the invention.
Figure 7:
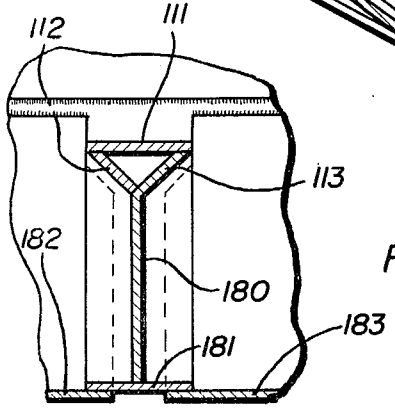
FIG. 7 is a sectional view taken along the line 7—7 of FIG. 6.

A second embodiment of the invention is shown in FIGS. 6 and 7. The four cross bearers 110 extend between the Zee-member chords 120 and 130 at each side of the car. Each cross bearer is triangular shaped (FIG. 7) and is formed of a cover plate 111 mounted on an angle formed of strip 112 and outwardly bent upper portion 113 of plate 180. The cover plate 111 is joined to the bottom surface of the webs of Zee-member chords 120 and 130. Heavy plate 114 is joined to the top of center sill 20 and extends over and is joined to the adjacent top ends of strip 112 and bent portion 113. Two tube stub elements 115 and 116 are joined to plate 114 and the lower ends of diagonal braces 121 and 131 are telescoped therein and bolted in place. Vertical gussets 117, 118 and 119 reinforce the tube stub elements 115 and 116.

At the top of side panel 122 there is positioned an inverted angle member 123 which constitutes an upper chord of a side sill. Similarly, the Zee-member 120 constitutes a lower chord of a side sill. Side posts 52 extend between the lower chord 120 and the upper chord 123. Vertical side wall 53 is joined at its top edge to upper chord 123 and at its lower edge to lower chord 120. The side wall 53 slopes outwardly as it extends upwardly to facilitate rotary discharge of lump and granular material from the car. The upper end of diagonal brace 121 is joined to reinforcing plate 124 near the top of wall 53. The other side of the railway car is similarly fabricated. Thus, the side panel 132 has an upper chord 133 made of an inverted angle member. Side posts 62 extend between the Zee-member lower chord 130 and the upper chord 133 which together constitute a side sill. Outwardly sloped side wall 63 is joined at its upper edge to upper chord 133 and at its lower edge to lower chord 130. A diagonal brace 131 is located over each cross bearer angle 110. The upper end of each diagonal brace 131 is joined to reinforcing plate 125 at the top portion of side wall 63.

Located between the car trucks 15 and 16 is a longitudinal trough 140 which extends from the car flat bottom portions 25 and 26. The trough 140 in cross section is close to being a cantenary in shape and for convenience in fabrication is made of three separate sections. The upper longitudinal side edges 141 and 142 of each of the trough sections is welded respectively to the inward vertical upwardly directed flange of the Zee-member lower chords 120 and 130 adjacent the Zee-member web. The lower edge of each of the vertical plates 180 coincides with the shape of each of the three trough sections. A metal strip 181 is welded to the lower edge of each vertical plate 180 located inwardly from the ends of trough 140. Each strip 181 has its ends welded to the bottom of the end portions of cover plates 111. These strips 181 provide support for the adjoining ends of the trough members 182–183 which are welded to the bottom of strips 181 as illustrated by FIG. 7 rather than to the top as shown in FIG. 4. Strips on vertical trough end plates 180 at the ends of the trough 140 extend only inwardly rather than to both sides of plate 180 as shown in FIG. 4. Only an inward extension is required to support the outer ends of the trough sections. A series of braces 191 extend from the lower edge of lower chord 120 to the trough and strips 181 to help support trough 140. Similarly, braces 192 extend from the lower edge of lower chord 130 to the trough and strips 181 to reinforce the trough. The described structure divides the trough 140 into three lading compartments in the same general manner as trough 70 in the embodiment of FIGS. 1 to 5. The entire trough 140 is spaced substantially below the bottom of the continuous center sill 20 to provide adequate clearance for lump or granular material to flow unobstructed beneath the sill.

The use of a trough generally cantenary shaped as shown in FIG. 6 results in increased horizontal forces (compared to the trough of FIG. 3 which has vertical side edges and a low horizontal force) exerted by the trough plate and directed inwardly towards the center sill when the car is loaded. These horizontal forces are very effectively opposed by the Zee-member lower chords 120 and 130 since the ends 141 and 142 of the trough apply the inward forces right at the horizontal webs 160 of each Zee-member which can best oppose the loading forces without bending or rotating. The horizontal forces exerted by the trough plate reduce the internal bending moments of the lower chords 120 and 130 at the cross-bearer connections and in-between the cross bearers caused by the lateral loadings, such as water and granular material. If the ends 141 and 142 of trough 140 were placed at the inner flange lower ends of channel chords 50 and 60 (FIG. 3) the horizontal loading forces would not be as effectively resisted. The use of the Zee-member also provides a horizontal web upper surface from which water and granular material can flow without obstruction. The Zee-member also provides the desired strength with light weight, an important factor in coal cars on long trips in unit trains.

Figure 8:
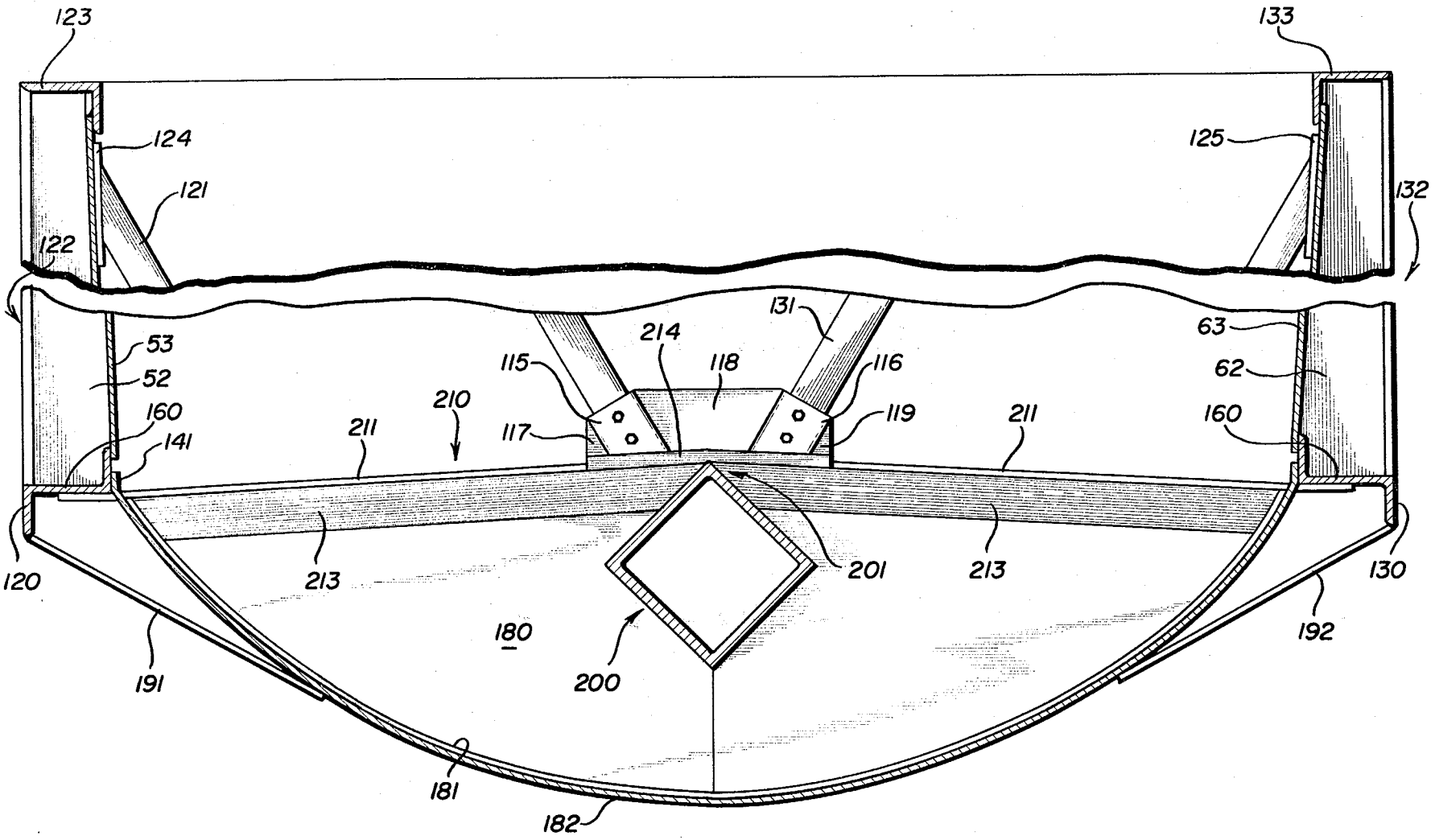
FIG. 8 is a sectional view, like FIG. 3, of a third embodiment of the invention.

A third embodiment of the invention is illustrated by FIG. 8. This embodiment is like the embodiment of FIG. 6 except for two differences. In the embodiment shown in FIG. 8 a square tube type center sill 200, generally like center sill 20, is rotated 45° from horizontal, to put one edge at top and the walls at 45°, to facilitate unloading granular material from the car by eliminating horizontal flat surfaces. Since the rotated center sill is desirably maintained in the center line of the draft the top edge 201 of the center sill is higher than the top of the center sill 20 (FIG. 6). Accordingly, to lower the center of gravity of the car the cross bearers 210 are sloped downwardly from the top edge 201 of the center sill. The cover plate 211 and the outwardly bent portion 213 (like bent portion 113) on vertical plate 180 slope downwardly. Plate 214, which spans the center sill on top of the cross bearers, has a downward slope from the center outwardly.

The foregoing detailed description has been given for clearness of understanding only, and no unnecessary limitations should be understood therefrom, as modifications will be obvious to those skilled in the art.

What is claimed is:

1. A gondola railway car comprising:

a car truck attached to each end of a continuous center sill, a pair of generally vertical end panels, a pair of generally vertical side panels joined to the end panels, a plurality of cross bearers extending from the center sill to a longitudinal chord at the bottom of each side panel, a vertical plate joined to each cross bearer extending downwardly terminating in a peripheral edge corresponding to the shape of the trough, a strip joined to each such plate peripheral edge and extending laterally therefrom between the longitudinal chords at the bottom of the side panels, the trough being in sections supported at the ends by such strips, a car bottom between the end and side panels having substantially flat portions over the truck and a longitudinal trough portion between the trucks and the flat bottom portions, the trough portion having side edges joined to the side panel bottom edges and extending beneath the center sill, and an end wall at each end of the trough extending to the adjacent flat bottom portion.

2. A gondola railway car comprising:

a car truck attached to each end of a continuous center sill, a pair of generally vertical end panels, a pair of generally vertical side panels joined to the end panels, a plurality of cross bearers extending from the center sill to a longitudinal chord at the bottom of each side panel, one of the sides of the cross bearers is an upper bent portion of a vertical plate extending downwardly to and joined to the trough surface over its width and depth, the cross bearers are essentially triangular in lateral section and the top surface in section is flat and horizontal, a car bottom between the end and side panels having substantially flat portions over the trucks and a lonitudinal trough portion between the trucks and the flat bottom portions, the trough portion having side edges joined to the side panel bottom edges and extending beneath the center sill, and an end wall at each end of the trough extending to the adjacent flat bottom portion.

3. A gondola railway car comprising:

a car truck attached to each end of a continuous center sill, a pair of generally vertical end panels, a pair of generally vertical side panels joined to the end panels, a plurality of cross bearers extending from the center sill to a longitudinal Zee-member chord at the bottom of each side panel with the Zee-member web horizontal and its inner flange extending upwardly from the web, a car bottom between the end and side panels having substantially flat portions over the trucks and a longitudinal trough portion, arced in lateral section, between the trucks and the flat bottom portions, the trough portion having side edges joined to the Zee-member chord inner flanges adjacent the web and extending beneath and spaced downwardly from the center sill, a vertical plate joined to several of the cross bearers extending downwardly and terminating in a peripheral edge corresponding to the shape of the trough and joined thereto, with at least two such vertical plates comprising trough end walls which extend to the adjacent flat bottom portion of the car, and a strip joined to the peripheral edge of each vertical plate and extending laterally therefrom between the longitudinal chords at the bottom of the side panels, and the trough is in sections supported at the ends by such strips.

4. A gondola railway car comprising:

a car truck attached to each end of a continuous center sill, a pair of generally vertical end panels, a pair of generally vertical side panels joined to the end panels, a plurality of cross bearers extending from the center sill to a longitudinal Zee-member chord at the bottom of each side panel with the Zee-member web horizontal and its inner flange extending upwardly from the web, a car bottom between the end and side panels having substantially flat portions over the trucks and a longitudinal trough portion, arced in lateral section, between the trucks and the flat bottom portions, the trough portion having side edges joined to the Zee-member chord inner flanges adjacent the web and extending beneath and spaced downwardly from the center sill, and a vertical plate joined to several of the cross bearers extending downwardly and terminating in a peripheral edge corresponding to the shape of the trough and joined thereto, with at least two such vertical plates comprising trough end walls which extend to the adjacent flat bottom portion of the car, and one side of the cross bearers is an upper bent portion of the vertical plate extending downwardly to and joined to the trough surface over its width and depth.

5. A gondola railway car comprising:

a car truck attached to each end of a continuous center sill, a pair of generally vertical end panels, a pair of generally vertical side panels joined to the end panels, a plurality of cross bearers extending from the center sill to a Zee-member longitudinal chord at the bottom of each side panel, and with the Zee-member web horizontal and the inner flange extending upwardly from the web, the cross bearers having a horizontal plate on the top extending from the center sill to, and lapping with, the web of the Zee-member, a car bottom between the end and side panels having substantially flat portions over the trucks and a longitudinal trough portion between the trucks and the flat bottom portions, the trough portion having side edges joined to the Zee-member inner flange adjacent the web, and extending beneath the center sill, and an end wall at each end of the trough extending to the adjacent flat bottom portion.

6. A gondola railway car comprising:

a car truck attached to each end of a continuous center sill, a pair of generally vertical end panels, a pair of generally vertical side panels joined to the end panels, a plurality of cross bearers extending from the center sill to a channel member longitudinal chord at the bottom of each side panel, and with the channel member web horizontal, the cross bearers having a horizontal plate on the top extending from the center sill to, and lapping with, the web of the channel member, a car bottom between the end and side panels having substantialy flat portions over the trucks and a longitudinal trough portion between the trucks and the flat bottom portions, the trough portion having side edges joined to the channel member inner flange, and extending beneath the center sill, and an end wall at each end of the trough extending to the adjacent flat bottom portion.

7. A gondola railway car comprising:

a car truck attached to each end of a continuous center sill, a pair of generally vertical end panels, a pair of generally vertical side panels joined to the end panels, a plurality of cross bearers extending from the center sill to a longitudinal chord at the bottom of each side panel, said chord having a horizontal web, a car bottom between the end and side panels having substantially flat portions over the trucks and a longitudinal trough portion between the trucks and the flat bottom portions, the trough portion having side edges joined to the side panel bottom edges and extending beneath the center sill, an end wall at each end of the trough extending to the adjacent flat bottom portion, and the cross bearers having a horizontal plate on the top extending from the center sill to, and lapping with, the chord horizontal web.

8. A gondola railway car comprising:

a car truck attached to each end of a continuous center sill, a pair of generally vertical end panels, a pair of generally vertical side panels joined to the end panels, a plurality of cross bearers securably extending from the center sill to a longitudinal Zee-member chord secured to the bottom of each side panel with the Zee-member web horizontal and its inner flange extending upwardly from the web, a car bottom between the end and side panels having substantially flat portions over the trucks and a longitudinal trough portion, arced in lateral section, between the trucks and the flat bottom portions, the trough portion having side edges joined to the Zee-member chord inner flanges adjacent the web and extending beneath and spaced downwardly from the center sill, a vertical plate joined to each of the cross bearers extending downwardly and terminating in a peripheral edge corresponding to the shape of the trough and joined thereto, with at least two such vertical plates comprising trough end walls which extend to the adjacent flat bottom portion of the car, a strip joined to the peripheral edge of each vertical plate and extending laterally therefrom between the Zee-member chords at the bottom of the side panels, the trough is in sections and each section is supportably secured at the ends to such strips, and a series of braces extending from the Zee-member chord outer flanges to the strips on the vertical plates.

9. A gondola railway car comprising:

a car truck attached to each end of a continuous center sill, a pair of generally vertical end panels, a pair of generally vertical side panels joined to the end panels, a plurality of cross bearers securably extending from the center sill to a longitudinal channel member chord secured to the bottom of each side panel with the channel member web horizontal and its inner flange extending vertically from the web, a car bottom between the end and side panels having substantially flat portions over the trucks and a longitudinal trough portion, arced in lateral section, between the trucks and the flat bottom portions, the trough portion having side edges joined to the channel member chord inner flanges adjacent the web and extending beneath and spaced downwardly from the center sill, a vertical plate joined to each of the cross bearers extending downwardly and terminating in a peripheral edge corresponding to the shape of the trough and joined thereto, with at least two such vertical plates comprising trough end walls which extend to the adjacent flat bottom portion of the car, a strip joined to the peripheral edge of each vertical plate and extending laterally therefrom between the channel member chords at the bottom of the side panels, and the trough is in sections and each section is supportably secured at the ends to such strips, and a series of braces extending from the channel member chord outer flanges to the strips on the vertical plates.

* * * * *

UNITED STATES PATENT AND TRADEMARK OFFICE

CERTIFICATE OF CORRECTION

PATENT NO. : 4,408,542

DATED : October 11, 1983

INVENTOR(S) : James C. Heap

It is certified that error appears in the above-identified patent and that said Letters Patent are hereby corrected as shown below:

Column 1, line 14, change "Another" to --Anthony--; column 2, line 5, change "may" to --made--; column 5, line 48, change "truck" to --trucks--; column 6, line 6, change "lonitudinal" to --longitudinal--.

Signed and Sealed this

Sixth Day of December 1983

[SEAL]

*Attest:*

GERALD J. MOSSINGHOFF

*Attesting Officer*

*Commissioner of Patents and Trademarks*